US009521494B2

(12) United States Patent
Nikles

(10) Patent No.: US 9,521,494 B2
(45) **Date of Patent: *Dec. 13, 2016**

(54) ANTENNA DEVICE FOR HEARING INSTRUMENTS AND A HEARING INSTRUMENT

(71) Applicant: SIVANTOS PTE. LTD., Singapore (SG)

(72) Inventor: Peter Nikles, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 201 days.

This patent is subject to a terminal disclaimer.

(21) Appl. No.: 14/299,144

(22) Filed: Jun. 9, 2014

(65) Prior Publication Data

US 2014/0363037 A1 Dec. 11, 2014

(30) Foreign Application Priority Data

Jun. 7, 2013 (DE) ..... 10 2013 210 689

(51) Int. Cl.
*H04R 25/00* (2006.01)
*H01Q 1/22* (2006.01)
(Continued)

(52) U.S. Cl.
CPC ..... *H04R 25/55* (2013.01); *H01Q 1/22* (2013.01); *H01Q 1/273* (2013.01); *H01Q 7/00* (2013.01); *H04R 25/554* (2013.01); *H04R 25/60* (2013.01); *H04R 25/604* (2013.01); *H04R 25/552* (2013.01); *H04R 2225/025* (2013.01); *H04R 2225/49* (2013.01); *H04R 2225/51* (2013.01)

(58) Field of Classification Search
CPC ... H04R 25/55; H04R 25/554; H04R 2225/51; H01Q 1/22; H01Q 1/273; H01Q 7/00
USPC ..... 381/315, 322, 324; 343/718, 841, 842, 343/706; 455/41.2
See application file for complete search history.

(56) References Cited

U.S. PATENT DOCUMENTS

2005/0168396 A1 8/2005 Victorian et al.
2008/0226108 A1 9/2008 Heerlein et al.
(Continued)

FOREIGN PATENT DOCUMENTS

DE 10 2006 043 909 B3 4/2008
EP 2124481 A2 11/2009

*Primary Examiner* — Jesse Elbin
(74) *Attorney, Agent, or Firm* — Laurence A. Greenberg; Werner H. Stemer; Ralph E. Locher

(57) ABSTRACT

An antenna system is provided for hearing instruments to be worn in the auditory canal. A hearing instrument has a data transmission system improved in respect of transmission bandwidth with no increase or only an insignificant increase in space and energy requirement. The antenna system has an antenna with a preferred send and receive spatial direction, and a hearing instrument component which emits noise radiation predominantly in a noise radiation spatial direction. The antenna and the hearing instrument component are disposed so that the send and receive spatial direction and the noise radiation spatial direction are oriented transverse to one another such that a coupling-in of noise radiation into the antenna is reduced. The reduction of the noise couplings into the antenna make possible a higher send and receive bandwidth, with the installation volume and energy requirement remaining the same. The hearing instrument component is a receiver.

9 Claims, 5 Drawing Sheets

(51) Int. Cl.
*H01Q 7/00* (2006.01)
*H01Q 1/27* (2006.01)

(56) References Cited

U.S. PATENT DOCUMENTS

| | | | | |
|---|---|---|---|---|
| 2009/0274328 | A1 | 11/2009 | Gebhardt et al. | |
| 2010/0195857 | A1* | 8/2010 | Gebhardt | H04R 25/554 381/317 |
| 2013/0188803 | A1* | 7/2013 | Shaanan | H04R 5/033 381/74 |
| 2014/0185848 | A1* | 7/2014 | Ozden | H04R 25/554 381/315 |
| 2015/0146900 | A1* | 5/2015 | Vonlanthen | H01Q 1/273 381/322 |

* cited by examiner

ANTENNA DEVICE FOR HEARING INSTRUMENTS AND A HEARING INSTRUMENT

CROSS-REFERENCE TO RELATED APPLICATION

This application claims the priority, under 35 U.S.C. §119, of German application DE 10 2013 210 689.0, filed Jun. 7, 2013; the prior application is herewith incorporated by reference in its entirety.

BACKGROUND OF THE INVENTION

Field of the Invention

The invention relates to an antenna device for hearing instruments, especially for hearing instruments to be worn in the auditory canal.

Hearing instruments can be configured as hearing devices for example. A hearing device is used to supply a hearing-impaired person with acoustic ambient signals which are processed and amplified for compensation or therapy of the respective hearing damage. In principle the device contains one or more input transducers, a signal processing device, an amplification device and an output transducer. The input transducer is generally a sound receiver, e.g. a microphone, and/or an electromagnetic receiver, e.g. an induction coil. The output transducer is generally implemented as an electro acoustic converter, e.g. miniature loudspeaker, or as an electromechanical converter, e.g. bone conduction earpiece. It is also referred to as an earpiece or receiver. The output transducer creates output signals which are conveyed to the hearing of the patient and are configured to create a perception of hearing in the patient. The amplifier is generally integrated into the signal processing device. The hearing device is supplied with power by a battery integrated into the hearing device housing. The main components of a hearing device are generally arranged on a printed circuit board as a circuit carrier or are connected thereto.

Hearing instruments, as well as being configured as hearing devices, can also be configured as what is referred to as tinnitus maskers. Tinnitus maskers are used for therapy of tinnitus patients. They create acoustic output signals depending on the respective hearing impairment and, in accordance with their principle of operation, also depending on ambient noises, which can contribute to reducing the perception of disruptive tinnitus or other noises in the ear.

Hearing instruments can also be configured as telephones, cell phones, headsets, headphones, MP3 players or other telecommunications or consumer electronics systems.

The term hearing instrument below is intended to be understood as both hearing devices and also tinnitus maskers, comparable devices of this type, as well as telecommunications and consumer electronics systems.

Various basic types of hearing instruments, especially hearing devices, are known. With in-the-ear (ITE) hearing devices a housing containing all functional components including a microphone and a receiver is worn at least partly in the auditory canal. Completely-in-canal (CIC) hearing devices are similar to the ITE hearing devices but are worn entirely in the auditory canal. With behind-the-ear (BTE) hearing devices a housing with components such as a battery and a signal processing device is worn behind the ear and a flexible sound tube conducts the acoustic output signals of a receiver from the housing to the auditory canal, where frequently an earpiece is provided on the tube for reliable positioning of the tube end in the auditory canal. Receiver-in-canal behind-the-ear (RIC-BTE) hearing devices are similar to the BTE hearing devices, however the receiver is worn in the auditory canal and instead of a sound tube a flexible receiver tube conducts electrical signals instead of acoustic signals to the receiver which is attached to the front of the receiver tube, mostly in an earpiece used for reliable positioning in the auditory canal. RIC-BTE hearing devices are frequently used as so-called open-fit devices, in which for reducing the disruptive occlusion effect, the auditory canal remains open for the passage of sound and air.

Deep-fit hearing devices are similar to the CIC hearing devices. While CIC hearing devices are generally worn however in a further-out (distal) section of the outer auditory canal, deep-fit hearing devices are pushed further in towards the eardrum (proximal) and are worn at least partly in the inner section of the outer auditory canal. The outer section of the auditory canal is a canal lined with skin and connects the ear muscle to the eardrum. In the outer section of the outer auditory canal which directly adjoins the ear muscle this canal is formed from elastic cartilage. In the inner section of the outer auditory canal the canal is formed from the temporal bone and thus consists of bone. The course of the auditory canal between the cartilaginous section and the bone section is generally angled in a (second) bend and encloses an angle which differs from person to person. The bony section of the auditory canal in particular is comparatively sensitive to pressure and movements. Deep-fit hearing devices are worn at least partly in the sensitive bony section of the auditory canal. On insertion into the bony section of the auditory canal they also have to pass the aforesaid bend which, depending on the angle, can be difficult. In addition small diameters and winding forms of the auditory canal can further complicate the insertion.

And as well as the hearing device types to be worn on or in the ear with acoustic receiver, cochlea implants and bone anchored hearing aids (BAHA) are also known.

Common to all hearing device types is that they aim to have the smallest possible housing or construction forms in order to enhance the wearing comfort, where necessary to improve the implant ability and if necessary to reduce the visibility of the hearing device for cosmetic reasons. The aim of having the smallest possible design also applies to most other hearing instruments.

Modern hearing instruments exchange control data via a radio system which is generally inductive. The transmission data rates needed for binaural coupled hearing instruments increase greatly if acoustic information for audio logical algorithms (e.g. beam-forming, side look etc.) is also to be transmitted. A higher data rate requires a greater bandwidth. One of the main influencing variables in respect of the sensitivity of the transmission system to noise signals is particularly the bandwidth.

With the high and individual packing density, particularly in ITE hearing instruments, hearing-instrument-internal noise signal sources are the main problem. This increases further with a widening of the bandwidth. With typical ITE hearing instruments the antenna is disposed on or partly in what is known as the faceplate (the wall of the hearing instrument facing away from the eardrum). The antenna is then typically located in the immediate vicinity of what is known as the hybrid (hybrid integrated circuit carrier) and the receiver. The hybrid and the receiver emit magnetic and electric fields which can have extreme effects on the transmission.

The arrangement of the antenna relative to the receiver and hybrid is decisive for the performance of the transmission system. Because of the high packing density a mutual shielding of the components is necessary. For this purpose the hybrid is typically enclosed by a shielding box. The receiver is given a shielding foil or is specifically designed so that it is magnetically sealed.

In German patent application DE 10 2013 204 681.2, corresponding to U.S. patent application Ser. No. 14/218,066, it is proposed that the antenna be disposed in the part of the hearing instrument facing towards the eardrum instead of on the faceplate. This achieves a positioning which reduces the influence of hybrid and receiver on the transmission system.

For the transmission path it is true to say, presented in somewhat simplified terms, that with the same antenna and the same energy requirement the distance to be covered shortens. Although the antenna could be built more efficiently, this is typically only guaranteed by increasing the antenna volume. One option for improving the transmission path consists of configuring the antenna so that a volume is used which would otherwise go to waste. This results in an enlargement of the antenna and thus an increase in the efficiency, without more room additionally being needed in the hearing instrument.

SUMMARY OF THE INVENTION

The object of the invention is to specify a hearing instrument, especially an ITE hearing instrument, which has a data transmission system improved in respect of transmission bandwidth with no increase or only an insignificant increase in space and energy demand.

The invention achieves this object by an antenna device and by a hearing instrument as claimed in the independent claims.

A fundamental idea of the invention consists of an antenna device for a hearing instrument with an antenna arrangement having a preferred send and receive spatial direction, and a further electric hearing instrument component which emits electromagnetic noise radiation predominantly in a noise radiation spatial direction. The antenna arrangement and the further hearing instrument component are arranged so that the send and receive spatial direction and the noise radiation spatial direction are arranged transverse to one another, in such a way that coupling-in of noise radiation into the antenna arrangement is reduced. The reduction of the noise couplings into the antenna arrangement makes possible a higher send and receive bandwidth while construction volume and energy requirements remain the same. The further hearing instrument component can involve a receiver or any other, especially inductive or electromagnetic, radiation-emitting component.

An advantageous development of the fundamental idea consists in the antenna arrangement containing a coil antenna, of the further hearing instrument component containing a coil arrangement which emits the noise radiation, and of the coil antenna and the coil arrangement being oriented, in relation to their respective longitudinal direction, transverse to one another. The magnetic field of a coil antenna has a definite spatial orientation so that, through the alignment transverse to one another, a definite reduction of the mutual noise coupling can be achieved.

A further advantageous development consists in the antenna arrangement having a coil core made of magnetic permeable material, which is shaped or designed at one end into an at least partly planar shield which is disposed transverse to the send and receive spatial direction of the antenna arrangement. The planar shield on the one hand has the effect of shielding against electromagnetic fields and already reduces mutual noise coupling in this way. In addition the shield has the effect, as a result of the permeability of the material, eventually, of so to speak a lengthening of the antenna or an increase in its efficiency. This gives rise to higher send field strength and a higher receives sensitivity.

A further advantageous embodiment consists of the further hearing instrument component being arranged on the shield. The arrangement of the hearing instrument component close to the antenna arrangements in this way with tolerably low mutual noise coupling is especially made possible by the mutual shielding. This results in a space-saving arrangement which is also suitable for pre-mounting of the antenna arrangement and the further hearing instrument component.

A further advantageous development consists of the further hearing instrument component being fastened to the shield. The fastening of the hearing instrument component to the shield forms, together with the antenna arrangement, a pre-mounted module. This simplifies the further assembly or production of the hearing instrument.

A further advantageous development consists of the shield surrounding the further hearing instrument component, at least in one section of its circumference in the direction facing away from the antenna core. This further increases the effectiveness of the shielding and further reduces the noise coupling, especially of the further component, into the antenna arrangement.

A further advantageous development consists of the coil core and/or the shield having metallization contacts for making electrical contact with the coil antenna. This obviates the need for additional mounting outlay and additional space requirement for making contact with the coil antenna, as would arise for example from fitting additional litz wires or flexible printed circuit tracks (flexible PCB) for making contact. The inner sides of the flange in this case are the most ideal surfaces for applying a metallization. This is where the field strength is at its lowest, fewer eddy current losses arise and there is only a slight impact on the quality of the antenna by making contact. The metallization on the flange also simplifies the automated production of the antenna, which once again makes possible or supports pre-mounting.

A further advantageous development consists of the further hearing instrument component being a receiver and of the coil core and the shield having a sound channel running through the coil antenna. With an ITE hearing instrument both components can in this way be placed in a space-saving manner as deep as possible into the ear. Thus an acoustically advantageous placing of the receiver as close as possible to the eardrum is achieved, while a placing of the coil antenna close to the ITE hearing instrument of the other (right or left) respective ear of the user is achieved, which positively influences the quality of mutual data transmission. The sound channel has the additional advantage that the field lines of the coil antenna are additionally compressed thereby in the send and receive direction and thus the quality of the antenna is further improved.

The receiver is an electro dynamic converter and thus the receiver contains a magnetic circuit which has an excitation winding. In operation the receiver is typically fed with a pulse-width-modulated signal, which possesses spectral components in the frequency band of the data transmission system. This kind of control is very energy-efficient and is therefore employed for hearing instruments. The spectral components cannot be avoided without a great increase in the energy demand of the hearing instrument. The receiver is the greatest consumer in the hearing instrument. By contrast the energy demand of the data transmission system is very small and accordingly it's receiving sensitivity in relation to magnetic noise sources is very great.

By arranging the receiver transverse to the antenna the magnetic circuit and thus also the receiver winding is aligned at 90° to the antenna. This greatly reduces the coupling-in of the receiver winding to the antenna. This enables the antenna to be placed significantly closer to the receiver.

The combination of the transverse receiver with the antenna is optimized for the tapering shell contour at the tip of the ITE hearing instrument and thus the length of the built-in instrument is minimized. Through its placement at the tip of the ITE hearing instrument the adaptation rate is increased and the hearing instrument is reduced in size. In addition more degrees of freedom in the positioning of the faceplate are made possible, since the antenna is no longer on or close to the faceplate. Furthermore the effort of placing the antenna on or close to the faceplate is avoided with since the tip of the ITE hearing instrument represents a position predetermined in advance. In this case there is no need to consider physical restrictions, e.g. magnetic field disturbances, which is required for placement in the area of the faceplate.

Since the receiver winding is not arranged centrally in relation to the receiver, which is usually not feasible for constructional reasons, and since the housing slightly deforms the field lines, with a very close proximity to the antenna a noise coupling is still produced. The noise coupling to the antenna can be reduced by an antenna core being used which is additionally provided with a shielding between receiver and antenna. The antenna core expanded to a flange in this way is produced completely from ferrite material or other permeable material. The flange preferably covers (best space/performance ratio) the entire surface of the receiver. Through the expanded antenna core the field lines of the excitation winding of the receiver are fed back in a concentrated manner so that only a small number of field lines pass through the antenna windings. Current is prevented from being induced in the antenna winding and thus noise couplings from the receiver are greatly reduced. The shielding by the antenna core embodied as a flange makes additional measures, for example shielding foil, and it's fitting unnecessary.

The flange is not only used for shielding but also additionally increases the sensitivity of the antenna. Therefore the antenna length could also be reduced, with the sensitivity remaining the same.

A further advantage of the flange is that the antenna quality can be increased. With the same inductance the number of windings required can be reduced by this method, so that in turn the diameter of the individual winding, typically lacquered copper wire, can be increased.

To increase the noise decoupling the flange can also extend around the edges of the receiver. For this all four edges of the receiver and also their permutations are conceivable and bring a more or less large increase in the decoupling effect.

The field line concentration and thus the field strength are reduced by the flange at the exit to the receiver. The low field strength causes fewer eddy currents in the metal surface of the receiver, through this the quality of the antenna increases. Therefore, with the quality remaining the same, the distance between the antenna and the receiver can be shortened. This effect is further reduced by the hole in the antenna, since the field lines concentrate at the edge in the flange area.

A further advantageous embodiment consists of the inner wall of the sound channel and/or the side of the shield facing away from the coil core being covered with sound-attenuating material. The effect of the sound attenuation is an advantageous vibration decoupling for the use of the receiver. The fact that the sound attenuating is integrated in the module containing the coil core, the coil antenna and the receiver means that a further pre-mounting and thus a further simplification of the further assembly and production of the hearing instrument is achieved.

As has been explained above, a fundamental idea of the invention consists of configuring the antenna so that it can be placed closer to a further hearing instrument component, without losing any performance by doing so. For this purpose an antenna device is specified, integrating different functions, for example shielding, making electrical contact, etc. in a small space. The arrangement especially makes it possible to work without additional space requirement and without additional components.

In addition the antenna can also be placed very close to the hearing instrument component and be combined as an integrated module. This simplifies the mounting. The arrangement of the receiver in relation to the antenna is pre-set and only one instead of two components is present. No special working steps are necessary for the fitting of the antenna. Also no additional components are necessary for a separate mounting. Instead the antenna module involves a part which can already be pre-mounted by an automated process before production.

Other features which are considered as characteristic for the invention are set forth in the appended claims.

Although the invention is illustrated and described herein as embodied in a antenna device for hearing instruments and a hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
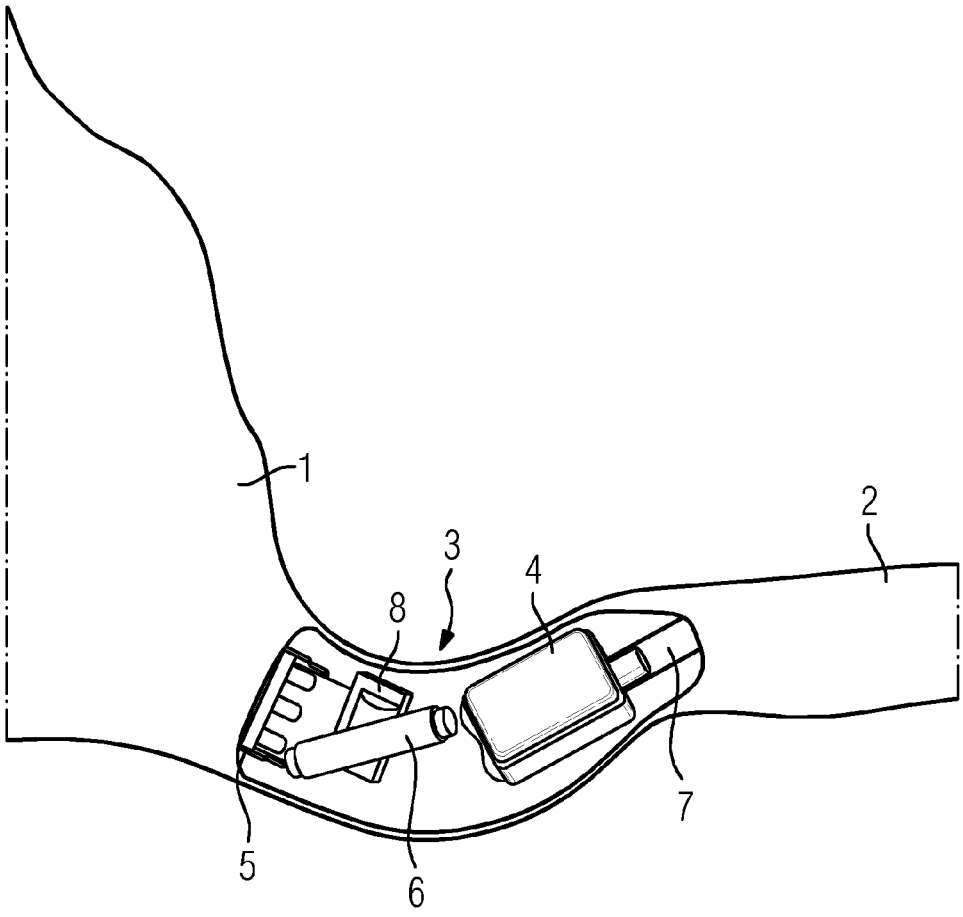
FIG. 1 Prior Art
FIG. 1 is an illustration of a prior art in-the-ear (ITE) hearing instrument.

Referring now to the figures of the drawings in detail and first, particularly to FIG. 1 thereof, there is shown a schematic diagram of an ITE hearing instrument 3 according to the prior art. The ITE hearing instrument 3 is inserted into an outer auditory canal of a hearing instrument wearer. It is located partly in an outer cartilaginous part 1 of the auditory canal and is pushed forward partly into the bony part 2 of the auditory canal. A deep-fit hearing instrument is thus involved.

In the hearing instrument 3 a receiver 4 is placed at an end oriented towards the eardrum. This emits acoustic signals towards an eardrum via a sound channel 7. A hybrid circuit carrier 8, which includes a non-illustrated signal processing device as well as an amplifier for creating control signals for the receiver 4, is arranged on a faceplate 5 arranged at the opposite end. An antenna 6 is likewise arranged on the faceplate 5 and is aligned so that it is oriented in the direction of the opposite ear of the hearing instrument wearer not shown FIG. 1. The antenna 6 is used for data transmission between the two binaural hearing instruments of the hearing instrument wearer, wherein only one of the two hearing instruments is shown.

It can be seen that the antenna is arranged comparatively close to the further electronic components of the hearing instrument 3, so that electromagnetic noise signals can couple from the components into the antenna 6. Such noise signals are especially emitted by the receiver 4 which has an inductive receiver coil which serves to convert electric signals into acoustic signals.

In addition the signals which the antenna 6 sends or receives, on the way to the opposite ear or hearing instrument of the hearing instrument wearer, must pass the receiver 4 which additionally negatively influences the data transmission path. The noise factors reduce the performance of the data transmission signals considerably so that a high bandwidth at the same time as a low energy demand can only be achieved to a limited extent.

Figure 2:
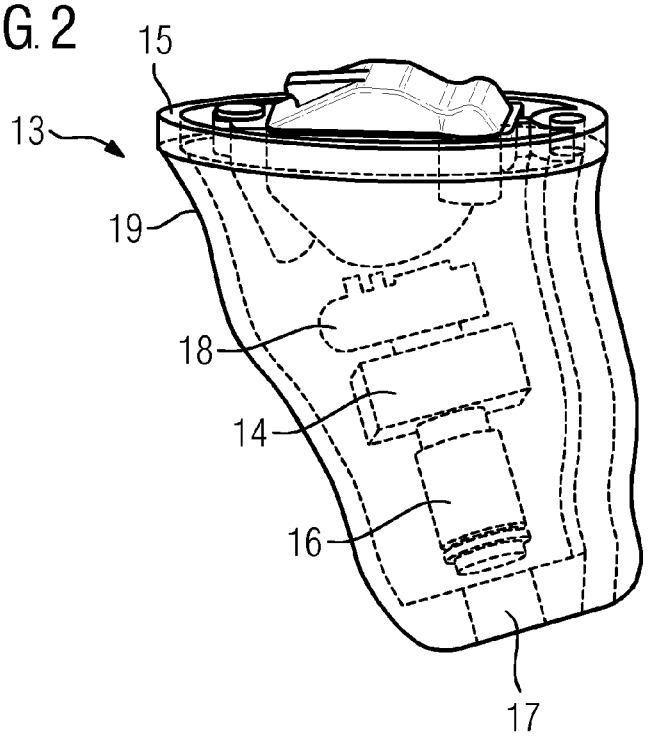
FIG. 2 is an illustration of an ITE hearing instrument with an antenna device according to the invention.

FIG. 2 shows a schematic diagram of an ITE hearing instrument with an antenna device. A housing 19 of the ITE hearing instrument 13 tapers on a side pointing towards the eardrum. A sound channel 17 on this side serves to emit acoustic signals towards the eardrum of the wearer.

On the opposite side the hearing instrument 13 is closed off by a faceplate 15, on which, as well as a battery not shown in FIG. 2 and likewise microphones not shown, a hybrid circuit carrier 18 (represented by a dashed line) is arranged inside the hearing instrument 13 or inside its housing 19 respectively. The hybrid circuit carrier 18 contains a signal processing device and also an amplification device, which issue control signals to the receiver 14 likewise arranged inside the housing 19. The receiver 14 creates acoustic output signals which are emitted via the sound channel 17.

The receiver 14 is oriented transverse to the longitudinal axis of the hearing instrument 13. The antenna 16 for data transmission between the two binaural hearing instruments of the hearing instrument wearer is located between receiver 14 and the tapered end of the hearing instrument 13 oriented towards the eardrum. The antenna 16 is oriented in the longitudinal direction of the hearing instrument 13 and is thus aligned transverse to the receiver 14.

The transverse alignment of the receiver 14 brings about a space-saving arrangement of the receiver 14 and the antenna 16, the overall length of which is reduced by the transverse arrangement of the receiver 14. In addition the transverse arrangement of the receiver 14 produces a better space utilization in the tapering part of the housing 19. The space available in the tapered tip of the housing 19 is thus better utilized than would be the case with a receiver arranged longitudinally.

Figure 3:
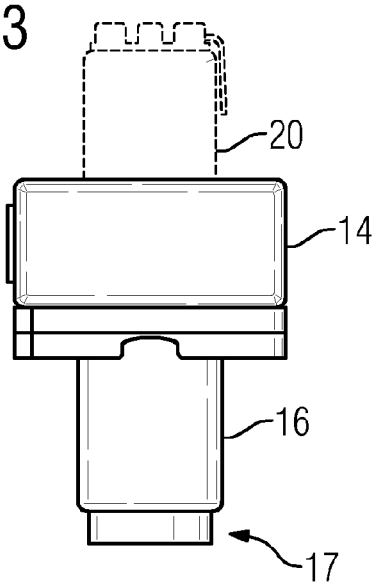
FIG. 3 is a diagrammatic, top plan view of the antenna device.

FIG. 3 again shows a schematic diagram of the antenna device. The sound channel 17 is located within the antenna 16 and runs through the antenna to the receiver 14. The receiver 14, as explained previously, is oriented transverse to the antenna 16 and to the longitudinal direction of the ITE hearing instrument 13. For explanation a longitudinally-arranged receiver 20 is shown as a dashed outline. The dashed-line arrangement of the receiver 20 makes it clear that the overall length increases with the longitudinal arrangement of the receiver 20, and that simultaneously no tapering contour of the arrangement is produced. As previously explained it is illustrated in this way that with the longitudinal arrangement of the receiver 20, the space in the tapered tip of the hearing instrument is not able to be as well utilized.

Figure 4:
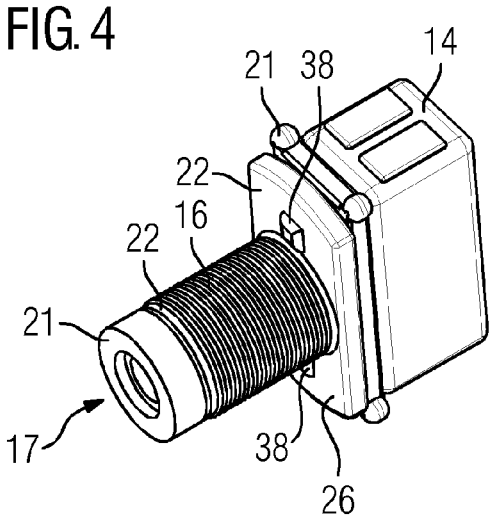
FIG. 4 is a diagrammatic, perspective view of an antenna receiver module.

FIG. 4 shows a perspective diagram of an antenna-receiver module. The receiver 14, as explained above, is oriented transverse to the antenna 16. The antenna 16 is arranged on a coil core 22 which is formed of a permeable material. The permeable coil core 22 thus serves in the normal way to optimize the antenna characteristics.

The end of the coil core 22 towards the receiver 14 is shaped as a shield 26. The shield 26 has a predominantly planar shape and is oriented transverse to the alignment of the antenna 16, i.e. in parallel to the alignment of the receiver 14. The surface of the shield 26 is dimensioned so that the receiver 14 is shielded entirely or almost entirely from the shield 26 of the antenna or conversely the antenna 16 is shielded from the receiver 14.

The sound channel 17 runs through the coil core 22 and through the shield 26 to the receiver 14. The coil core 22 is covered on its inside by a sound-deadening or vibration-deadening material shaped as a tube 21. The tube 21 surrounds the sound channel 17 from the antenna-side output through to the receiver 14 and is shaped there in a planar shape in parallel to the shield 26. The receiver 14 is attached to the planar-shaped part of the tube 21 and thus is likewise insulated from vibration. Round continuations of the sound-deadening or vibration-deadening material are used for the additional vibration-decoupled suspension integrated into the device of the device in the housing of the hearing instrument.

The coil core 22, together with the tube 21, the antenna 16 and also the receiver 14, forms an antenna-receiver module. The module can be inserted into the hearing instrument pre-installed or preassembled. The pre-assembly of the antenna-receiver module on the flange formed by the coil core 22 or by the tube 21 reduces the installation outlay during the production of the hearing instrument and thus simplifies the manufacturing process.

A further simplification is achieved by the coil core 22 being equipped with metallization contacts 38 which are used for making electrical contact with the antenna 16. Conductor tracks not shown in FIG. 4 connect the metallization contacts 38 to the terminals of the antenna 16. For this purpose further metallization contacts not shown in the FIG. 4 can be provided, with which the winding or windings of the antenna 16 are contacted.

Figure 5:
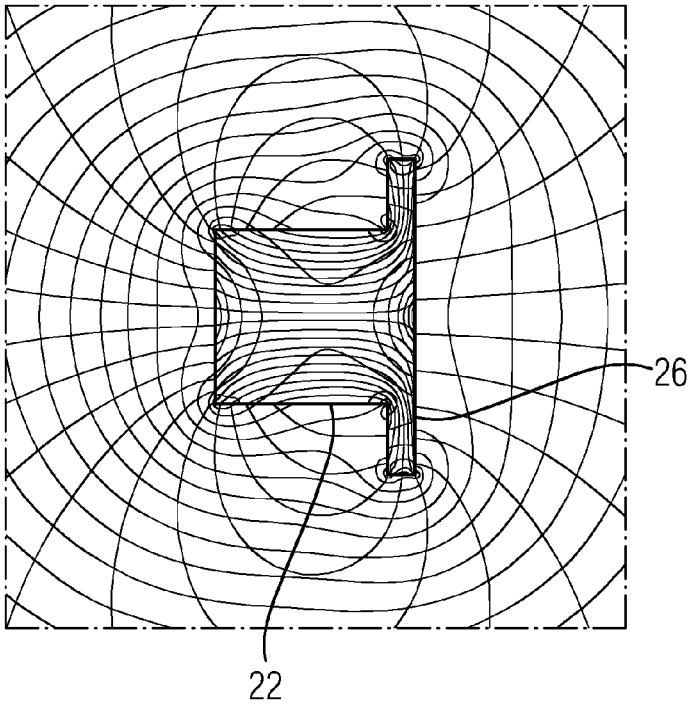
FIG. 5 is an illustration showing a field line distribution of a coil antenna with shielding.

FIG. 5 shows a schematic diagram of the field line distribution of the coil antenna with shielding. The permeable coil core 22 along with the shield 26 has the effect, as becomes clear from the simulation shown, on the one hand of providing shielding of the area facing away from the antenna 16 behind the shield 26. A receiver arranged in this area is consequently protected by the shield 26 against noise signals from the antenna.

In addition it can be seen that the field line density in the axial direction on the side of the antenna lying opposite the shield 26, thus in the sender and received direction of the antenna, is increased. The coil core 22 with the shaped-on shield 26 therefore causes an optimized field characteristic for sending and receiving of data in the axial direction. This effect is additionally increased if, which is not the case in the simulation shown, the coil core 22 has a through-opening, for example the previously-explained sound channel.

Figure 6:
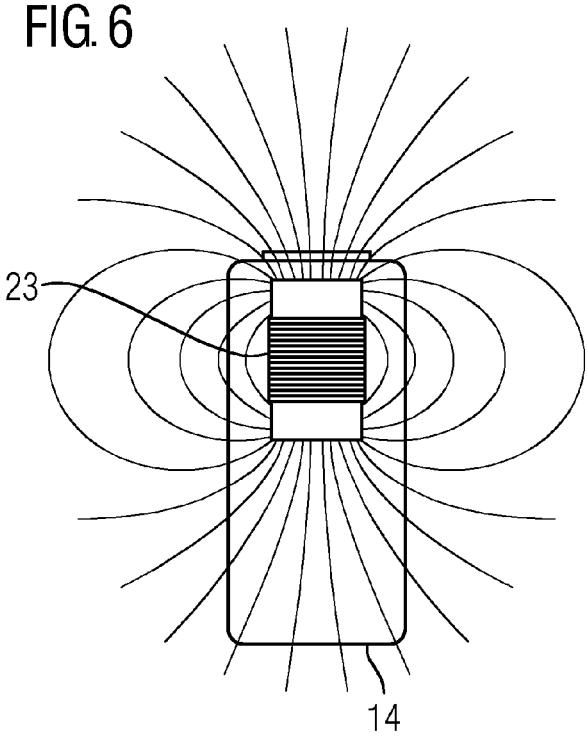
FIG. 6 is an illustration showing a course of field lines through the receiver.

FIG. 6 shows a schematic diagram of the field line course of a receiver operating with the receiver coil. In the receiver 14 a receiver coil 23 is arranged axially, i.e. oriented in the longitudinal direction. It can be seen that the receiver coil 23 creates a strongly compressed (magnetic) field in the axial direction, while it creates a comparatively weak (magnetic) field in the radial direction, i.e. to the right and left in the figure.

It is evident from this that electromagnetic signals which the receiver 14 emits are more strongly marked in its longitudinal direction than in its transverse direction. Thus the effect of the arrangement previously explained, in which the antenna which can receive electromagnetic noise signals is not disposed longitudinally but transverse to the receiver, causes a marked decoupling of the electromagnetic signals of the receiver 14 from the antenna. The decoupling is further improved by the antenna not only being disposed laterally from the receiver 14, but also being oriented transverse to the latter.

Figure 7:
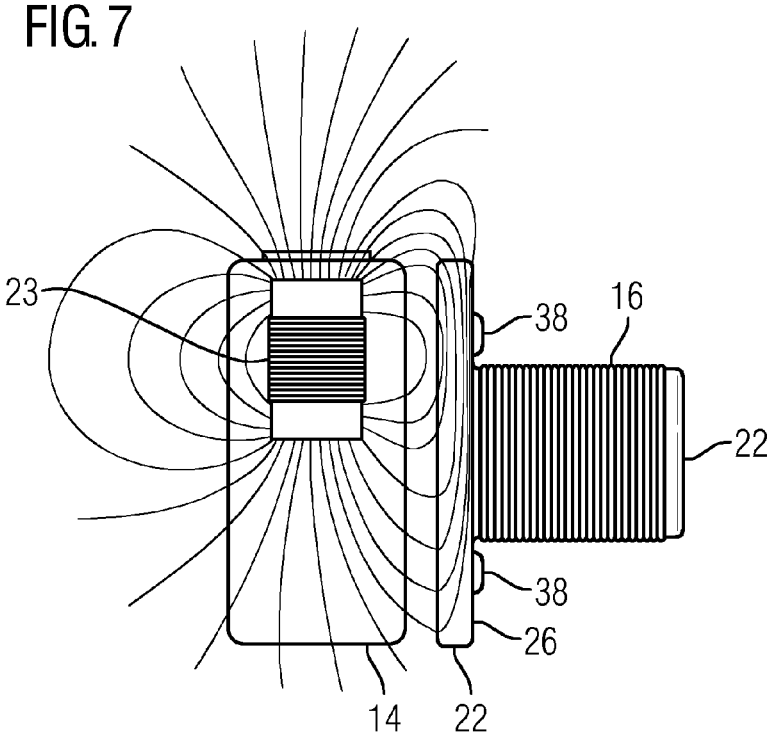
FIG. 7 is an illustration showing the course of field lines through the receiver with shielding.

FIG. 7 shows the course of the field lines of the receiver with shielding. The receiver 14 is arranged in the diagram to the right of the previously explained shield 26 of the permeable coil core 22. On the other side of the shield 26 the coil core 22 bears the antenna 16. Previously explained metallization contacts 38 are integrated into the coil core 22 and are used for making electrical contact with the antenna 16.

The course of the field lines shown illustrates the shielding of the antenna 16 from the receiver 14 or from the signals of the receiver coil 23 respectively. The field lines running in the direction of the antenna 16 are deformed by the shield 26 and pass through it. The field line density in the shield 26 is thus increased while the field line density on the other side of the shield 26 is simultaneously reduced thereby. In other words the strength of the (magnetic) field created by the receiver coil 23 reduces greatly at the location of the coil 16. Thus noise couplings of receiver signals into the antenna 16 are significantly reduced.

Figure 8:
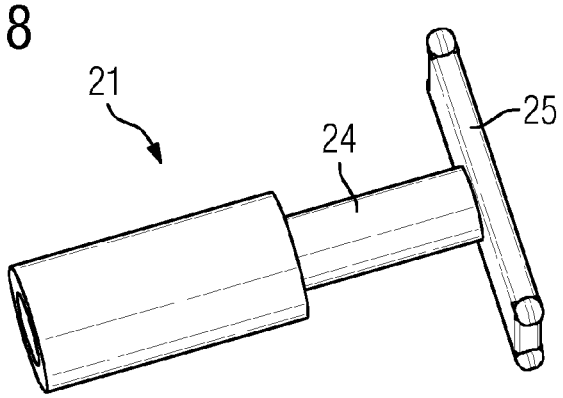
FIG. 8 is a diagrammatic, perspective view of a tube.

FIG. 8 shows the previously explained sound-deadening tube separately. The tube 21 has the sound channel running through it in the longitudinal direction. A flange section 24 is intended to accommodate the previously explained coil core 22. The coil core 22 is disposed around the flange section 24, if necessary also around the further longitudinal extent of the tube 21. A shielding section 25 is intended to accommodate the section of the coil core shaped out as the shield. The coil core section shaped out as the shield in this case is placed on one side of the shield section 25 while a receiver is disposed on the opposite side of the shield section 25. The tube 21 shown consists completely of sound-deadening material for example of Viton in the conventional manner.

Figure 9:
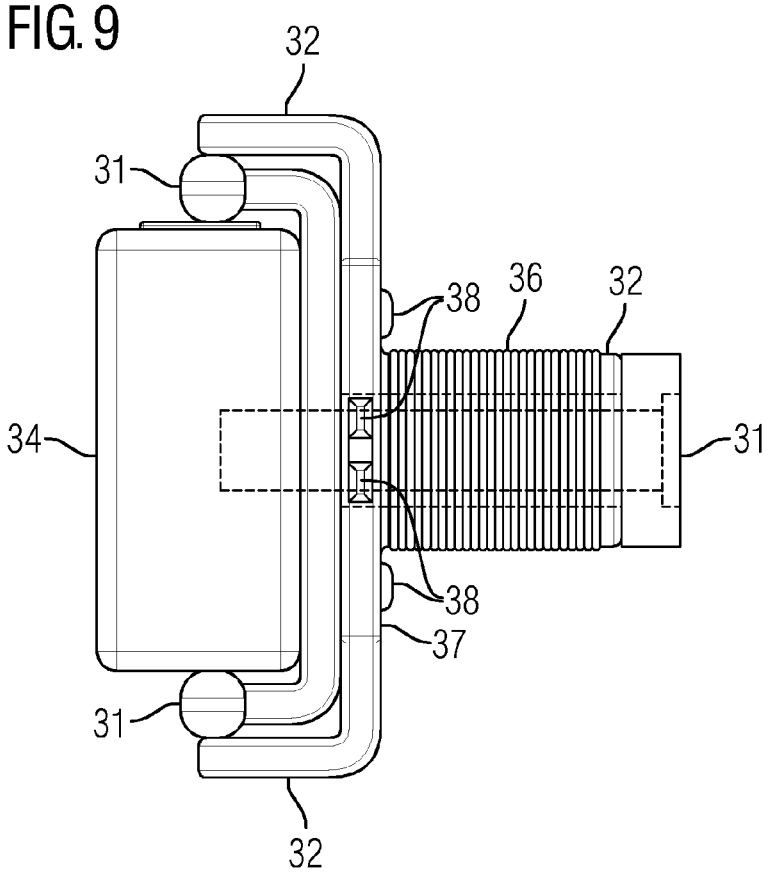
FIG. 9 is a side view of an antenna receiver module.

FIG. 9 shows a further embodiment of the antenna-receiver module. The coil core 32, as explained previously is shaped onto one side as a shield 37. An antenna 36 is wound onto a coil core 32. Metallization contacts 38 are used for making electrical contact with the antenna. On the side facing away from the antenna 36 the coil core 32 surrounds a receiver 34 disposed there at least in the area shown in the figure above and below. To this end the shield 37 or the coil core 32 is embodied in a beaker shape there so that the receiver 34 is surrounded by the coil core 32 or by the shield 37 respectively at least in one area of the shield circumference in the direction facing away from the antenna 36.

An especially good shielding is produced when the shield 37 surrounds the receiver 34 on all sides. A further improvement of the shielding can be achieved by the shield 37 surrounding the receiver 34 entirely and not merely to the sides. This produces a further improvement of the antenna which can either be used for increasing the bandwidth but also for making the antenna shorter while maintaining the same performance.

The coil core 32 runs through a sound channel, of which the tube 31 running through it is covered with sound-deadening material. The tube 31 is likewise embodied flat in the area of the shield 37 or in the shape of a beaker and accommodates the receiver 34 to attenuate vibration. The receiver 34 is attached to each tube 31 or the coil core 32 respectively. The receiver-antenna module shown can be pre-installed so that further assembly and manufacturing of the hearing instrument is significantly simplified.

The invention claimed is:

1. An antenna system for a hearing instrument, the antenna system comprising:

an antenna configuration having a main send and receive spatial direction, said antenna configuration including a coil core made of a magnetically-permeable material and having an end which is shaped out into an at least partly planar shield that is disposed transverse to the send and receive spatial direction of said antenna configuration; and an electrical hearing instrument component emitting electromagnetic noise radiation predominantly in a noise radiation spatial direction, said antenna configuration and said hearing instrument component being disposed so that the main send and receive spatial direction and the noise radiation spatial direction are oriented transverse to one another such that a coupling-in of the noise radiation into said antenna configuration is reduced.

2. The antenna system according to claim 1, wherein:

said antenna configuration includes a coil antenna; and said hearing instrument component includes a coil configuration which emits the noise radiation and that said coil antenna and said coil configuration are oriented transverse to one another in respect of their respective longitudinal direction.

3. The antenna system according to claim 1, wherein said hearing instrument component is disposed on said planar shield.

4. The antenna system according to claim 3, wherein said hearing instrument component is fastened to said planar shield.

5. The antenna system according to claim 3, wherein said planar shield, in at least one section of its circumference, surrounds said hearing instrument component in a direction facing away from said antenna configuration.

6. The antenna system according to claim 3, wherein said coil core and/or said planar shield has metallization contacts for making electrical contact with said antenna configuration.

7. The antenna system according to claim 3, wherein:

said hearing instrument component is a receiver; and said coil core and said planar shield have a sound channel running through them.

8. The antenna system according to claim 7, further comprising a sound-attenuating material;

wherein said sound channel has an inner wall; and wherein said planar shield has a side facing away from said coil core, said inner wall of said sound channel and/or said side of said planar shield is covered with said sound-attenuating material.

9. A hearing instrument, comprising:

an antenna system containing:

an antenna configuration having a main send and receive spatial direction, said antenna configuration including a coil core made of a magnetically-permeable material and having an end which is shaped out into an at least partly planar shield that is disposed transverse to the send and receive spatial direction of said antenna configuration; and an electrical hearing instrument component emitting electromagnetic noise radiation predominantly in a noise radiation spatial direction, said antenna configuration and said hearing instrument component being disposed so that the main send and receive spatial direction and the noise radiation spatial direction are oriented transverse to one another such that a coupling-in of the noise radiation into said antenna configuration is reduced.

* * * * *